US011035138B2

(12) United States Patent
Leighton et al.

(10) Patent No.: US 11,035,138 B2
(45) Date of Patent: Jun. 15, 2021

(54) BLEACHER DECK INTERLOCK APPARATUS AND METHOD

(71) Applicant: Hussey Seating Company, North Berwick, ME (US)

(72) Inventors: Michael L. Leighton, Saco, ME (US); Chi-lam Yau, Dover, NH (US)

(73) Assignee: Hussey Seating Company, North Berwick, ME (US)

( * ) Notice: Subject to any disclaimer, the term of this patent is extended or adjusted under 35 U.S.C. 154(b) by 0 days.

(21) Appl. No.: 16/668,901

(22) Filed: Oct. 30, 2019

(65) Prior Publication Data

US 2020/0141142 A1 May 7, 2020

Related U.S. Application Data

(60) Provisional application No. 62/754,900, filed on Nov. 2, 2018.

(51) Int. Cl.
*E04H 3/12* (2006.01)
*A47C 1/126* (2006.01)

(52) U.S. Cl.
CPC ..... *E04H 3/126* (2013.01); *A47C 1/126* (2013.01)

(58) Field of Classification Search
CPC ..... E04H 3/123; E04H 3/126; A47C 1/12; A47C 1/126
See application file for complete search history.

(56) References Cited

U.S. PATENT DOCUMENTS 2,815,541 A * 12/1957 Anderson ..... E04H 3/123 52/9
2,846,738 A * 8/1958 Walworth ..... E04H 3/123 52/9
2,870,492 A * 1/1959 Chervenka ..... E04H 3/123 52/9
2,983,968 A * 5/1961 Wurn ..... E04H 3/126 52/9
2,990,587 A * 7/1961 Murphy ..... E04H 3/123 52/10
3,069,732 A * 12/1962 Murphy ..... E04H 3/123 52/10
3,142,871 A * 8/1964 Harms ..... E04H 3/126 52/10
3,279,131 A * 10/1966 Curra, Jr. ..... E04H 3/123 52/9
3,389,511 A * 6/1968 Drehobl ..... E04H 3/123 52/9
3,429,081 A * 2/1969 McClelland ..... E04H 3/123 52/9

(Continued)

*Primary Examiner* — James M Ference
(74) *Attorney, Agent, or Firm* — Preti Flaherty; Beliveau & Pachios LLP

(57) ABSTRACT

Apparatus for securing adjacent tiers of a retractable bleacher to prevent relative vertical movement between the adjacent tiers when the retractable bleacher is fully extended are described. The retractable bleacher includes a first engagement member that is secured to a first decking tier, a second engagement member secured to a second adjacent decking tier. The first engagement member and the second engagement member are configured and cooperative to prevent relative vertical movement of the second decking tier with respect to the first decking tier when the retractable bleacher is fully extended in the open configuration.

15 Claims, 17 Drawing Sheets

(56) References Cited

U.S. PATENT DOCUMENTS 3,667,171 A * 6/1972 McClelland ..... A47C 1/126 52/9
3,768,215 A * 10/1973 Raymond ..... E04H 3/123 52/9
4,000,586 A * 1/1977 Vance ..... E04H 3/123 52/9
4,045,921 A * 9/1977 Molloy ..... E04H 3/123 52/9
4,063,392 A * 12/1977 Van Ryn ..... A47C 1/126 52/9
4,155,202 A * 5/1979 Hartman ..... E04H 3/123 52/9
4,189,876 A * 2/1980 Crossman ..... A47C 1/126 52/9
4,446,659 A * 5/1984 Quigley ..... E04H 3/123 297/331
4,467,569 A * 8/1984 Blanchard ..... E04H 3/123 297/15
4,557,080 A * 12/1985 Walworth ..... E04H 3/123 297/332
4,565,036 A * 1/1986 Lyman, Jr. ..... E04H 3/123 297/DIG. 2
4,571,895 A * 2/1986 Lyman, Jr. ..... E04H 3/123 108/93
4,850,159 A * 7/1989 Conner ..... A47C 1/126 52/9
5,069,007 A * 12/1991 Paddock ..... E04H 3/123 52/9
5,459,964 A * 10/1995 Doublet ..... A47C 1/126 52/7
5,559,411 A * 9/1996 Winship ..... E04H 3/123 297/16.2
5,784,835 A * 7/1998 McArthur, Jr. ..... E04H 3/123 182/131
5,822,929 A * 10/1998 Guiles ..... E04H 3/123 52/9
6,003,270 A * 12/1999 MacIntyre ..... E04H 3/126 52/10
6,041,554 A * 3/2000 McArthur, Jr. ..... E04H 3/123 52/183
6,212,828 B1 * 4/2001 McArthur, Jr. ..... E04H 3/123 52/8
6,244,657 B1 * 6/2001 Momose ..... A47C 1/126 297/217.7
6,324,790 B1 * 12/2001 Victor ..... E04H 3/123 297/236
6,354,041 B1 * 3/2002 Guiles ..... E04H 3/123 182/132
6,539,672 B1 * 4/2003 Frost ..... E04H 3/123 292/130
6,598,351 B2 * 7/2003 Hallberg ..... E04H 3/123 52/6
6,615,548 B1 * 9/2003 Nakamura ..... E04H 3/126 297/236
6,854,216 B2 * 2/2005 Ahrens ..... E04H 3/123 52/183
7,546,705 B1 * 6/2009 Rivera, Jr. ..... E04H 3/126 182/132
7,900,402 B2 * 3/2011 Staten ..... E04H 3/126 52/10
8,296,999 B2 * 10/2012 Uhl ..... E04H 3/126 52/9
8,438,786 B2 * 5/2013 Jacobs ..... E04H 3/123 52/9
9,332,846 B2 * 5/2016 Koch ..... A47C 1/124
9,540,831 B2 * 1/2017 Koch ..... E04H 3/30
9,650,796 B2 * 5/2017 Klingenberg ..... E04H 3/126
9,752,338 B2 * 9/2017 Strayer, Jr. ..... E04H 3/123
10,053,881 B2 * 8/2018 Briggs ..... E04H 3/123
2008/0190038 A1 * 8/2008 Jacobs ..... E04H 3/123 52/9
2011/0099915 A1 * 5/2011 Sudkamp ..... E04H 3/123 52/9
2012/0144757 A1 * 6/2012 Hockemeyer ..... A47C 1/12 52/9
2013/0055647 A1 * 3/2013 Favell ..... E04H 3/123 52/7
2020/0141142 A1 * 5/2020 Leighton ..... A47C 1/126

* cited by examiner

BLEACHER DECK INTERLOCK APPARATUS AND METHOD

STATEMENT REGARDING FEDERALLY SPONSORED RESEARCH OR DEVELOPMENT

N/A

BACKGROUND OF THE INVENTION

Various embodiments relate generally to bleacher systems and devices and, more specifically, relate to a deck interlock assembly for a retractable bleacher.

This section is intended to provide a background or context. The description may include concepts that may be pursued, but have not necessarily been previously conceived or pursued. Unless indicated otherwise, what is described in this section is not deemed prior art to the description and claims and is not admitted to be prior art by inclusion in this section.

Folding and telescopic seating structures are bleachers that can be extended for use and closed so as to be retracted into a vertical stack of tiered seating to save floor space. FIGS. 1*a*-1*d* illustrate a prior art retractable bleacher. As illustrated, the bleacher includes multiple tiers of decking. Each tier, when open or closed, needs to slide past the adjacent tier or tiers. This relative movement necessitates operating clearances. The operating clearance, when the bleacher is fully extended open as shown in FIG. 1*a*, can manifest itself in vertical deck motion as the decks are loaded and the operational clearance taken up—which some users may find unnerving. This movement can also cause noise typically resulting from metal on metal impact which some refer to as "deck slap."

FIG. 1*c* is a perspective view of a portion of the understructure of the prior art bleacher of FIG. 1*a* illustrating a lower stabilizer and an upper stabilizer with the retractable bleacher fully extended. FIG. 1*d* is a perspective view of the lower stabilizer of FIG. 1*c*. The lower stabilizer consists of an open channel shape extending horizontally and supporting the deck, and a vertical portion extending vertically upward and terminating in a roller. The roller is captively mounted on a headed pin which allows for some up and down (vertical) float of the roller. The roller tracks inside the horizontal open channel shape of an upper stabilizer as seen in FIG. 1*c*. This effectively interlocks the lower stabilizer to the upper stabilizer, ensuring engagement of the lower row to the upper row throughout the opening and closing cycle. As the bleacher rows extend open and retract closed, this arrangement also ensures straight tracking of the bleacher rows in the lateral direction, while permitting a certain amount of relative vertical movement of the lower stabilizer with respect to the upper stabilizer, by way of the floating roller. This degree of vertical movement is important to the operation of the bleacher, in that it allows for smooth tracking as the bleacher rows extend and close over variations in the floor. However, this freedom in vertical movement is desirable only during the opening and closing cycle—not when the bleacher is fully extended.

Because the adjacent tiers of folding and telescopic seating systems are required to slide past each other, operating clearances or allowances need to be designed in. This is typically done in various manners. One approach is to build in camber to the frame pair supporting each individual deck assembly. With this approach, either the angle of the frame's support column welded to the wheeled track, or the angle of the frame's cantilever welded to the support column, or both, are welded at deliberately "non-square" angles, so that the deflection due to the weight of the deck structure, when assembled, nearly or completely levels out the deck. With this approach a lot of the closing friction can be eliminated. However, a downside is that the amount of camber designed into the frames is the same, whereas the weights of the telescopic decks vary widely (based on short vs. long section sizes, heavy vs. light deck accessories, etc.) Thus, the amount of camber can be too much, resulting in a bouncy feeling to the decks when walked upon (particularly when lightly loaded well below capacity), or too little, resulting in excessive closing friction which degrades the operational performance of the telescopic platform.

A second common approach is to design frames with adjustable cantilevers. With adjustable cantilevers, the cantilever-to-frame column angle can be field adjusted, to fine tune the designed amount of operating clearance to allow the telescopic seating structure to close easily, but not enough camber to result in decks that feel bouncy when walking upon. There are numerous downsides to this approach. The design of an adjustable cantilever adds complexity and cost—and some design approaches are purely ineffective. Also, each individual tier may need to be field adjusted to "tune" the bleacher, adding expensive installation labor. And these adjustments can fall out of specification over time, requiring more adjusting over time.

It would be desirable to have a deck interlock mechanism that serves to reduce or eliminate this undesirable movement or deck slap that is experienced as users traverse the bleacher and its associated noise. Additionally, it would be desirable for the deck interlock mechanism to serve to rigidly secure the upper and lower deck assemblies of a bleacher to provide the precisely designed vertical clearance between adjacent tiers when the retractable bleacher is in its fully extended orientation. This clearance would be consistent from tier to tier irrespective of short versus long section sizes, heavy versus light deck accessories, etc.

BRIEF SUMMARY OF THE INVENTION

The below summary is merely representative and non-limiting.

The above problems are overcome, and other advantages may be realized, by the use of the embodiments.

In a first aspect, an embodiment provides a deck interlock apparatus for maintaining a designed vertical clearance between adjacent tiers of a retractable bleacher when the bleacher is in a fully extended orientation. In this embodiment, the deck interlock apparatus includes a first deck interlock member that is mounted to a rear support portion extending upward from the rearward end of a first stabilizer and a second deck interlock member that is mounted to the forward end of a second stabilizer that is disposed at a height above the first stabilizer. The first stabilizer is longitudinally movable in a direction generally parallel to the second stabilizer as the retractable bleacher is opened or closed. The first and second deck interlock members are disposed in abutting relationship and cooperative when the retractable bleacher is fully extended in the open configuration to prevent vertical movement between a first tier including the first stabilizer and a second tier including the second stabilizer.

More specifically, the first interlock member comprises a pawl that is mounted to the upper end of a rear support portion that extends upward from the rearward end of a first stabilizer and the second interlock member comprises a capture bracket that is mounted to the forward end of a second stabilizer disposed at a height above the first stabilizer. The first stabilizer is longitudinally movable with respect to the second stabilizer in response to the opening and closing of the retractable bleacher. When the retractable bleacher is closed, the second stabilizer is disposed generally above and parallel to the first stabilizer. Upon full extension of the retractable bleacher a pawl finger extending from the pawl mounted to the rear support portion of the first, lower stabilizer engages the capture bracket mounted to the forward end of the second, upper stabilizer to rigidly secure the tiers associated with the first and second stabilizers to assure a designed vertical operational clearance between the adjacent tiers and to prevent vertical movement therebetween. In the above-described manner, "deck slap" and the undesirable noise associated therewith is avoided. Further, the "rise" or elevation change from tier to tier is precisely and consistently maintained.

BRIEF DESCRIPTION OF THE SEVERAL VIEWS OF THE DRAWINGS

Various aspects are discussed below with reference to the accompanying figures. It will be appreciated that for simplicity and clarity of illustration, elements shown in the drawings have not necessarily been drawn accurately or to scale. For example, the dimensions of some of the elements may be exaggerated relative to other elements for clarity or, several physical components may be included in one functional block or element. Further, where considered appropriate, reference numerals may be repeated among the drawings to indicate corresponding or analogous elements. For purposes of clarity, not every component may be labeled in every drawing.

Aspects of the described embodiments are more evident in the following description, when read in conjunction with the attached Figures.

DETAILED DESCRIPTION OF THE INVENTION

Figure 1A:
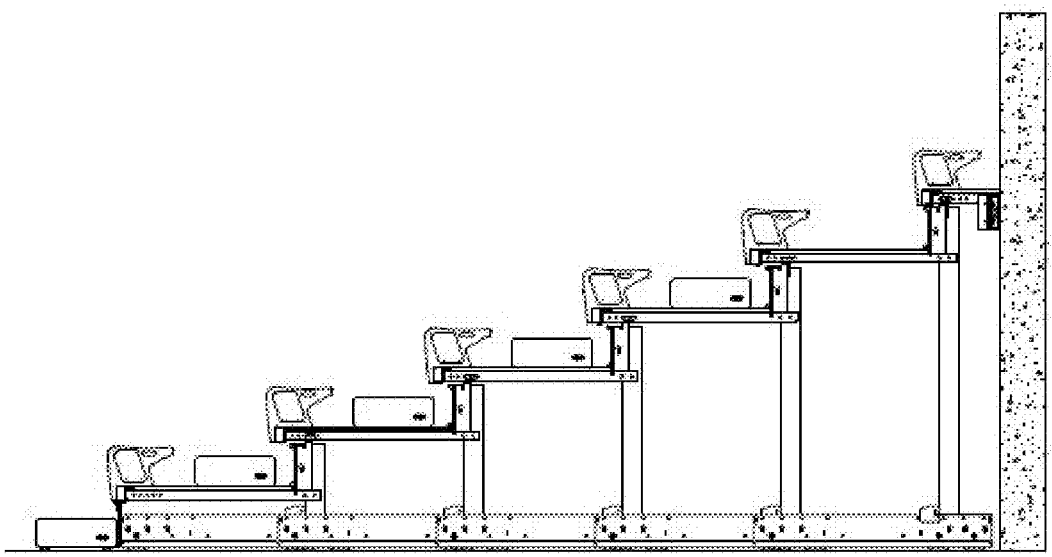
Fig. 1a Prior Art
FIG. 1*a* is a side elevation view of a prior art retractable bleacher in an extended or open configuration.
Figure 1B:
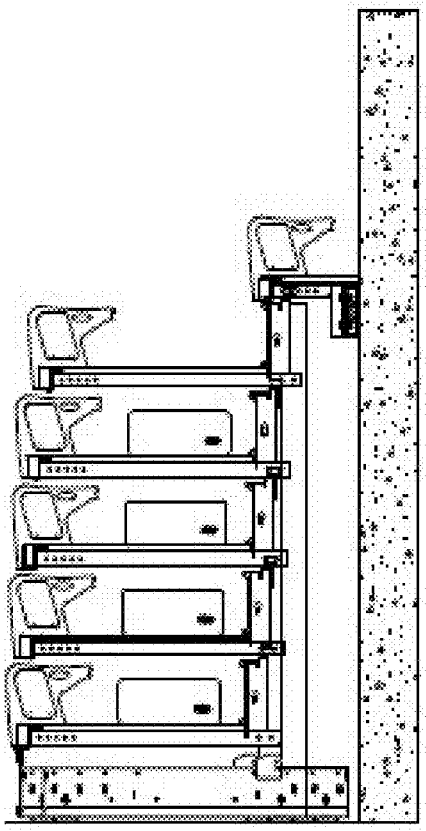
Fig. 1b Prior Art
FIG. 1*b* is a side elevation view of a prior art retractable bleacher in a retracted or closed configuration.
Figure 1C:
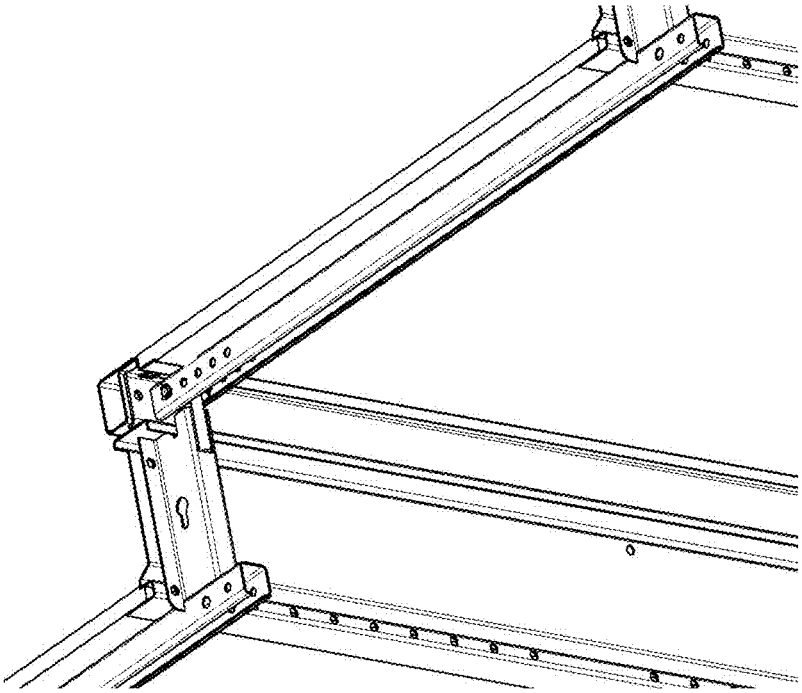
Fig. 1c Prior Art
FIG. 1*c* is a perspective view of a portion of the frame structure of the prior art bleacher of FIG. 1*a* illustrating a lower stabilizer and an upper stabilizer with the retractable bleacher fully extended.
Figure 1D:
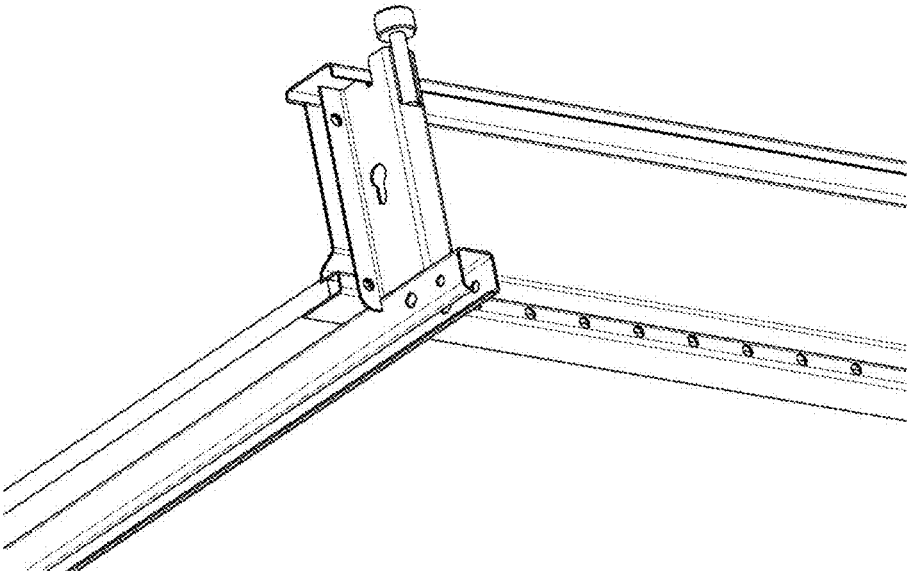
Fig. 1d Prior Art
FIG. 1*d* is a perspective view of the lower stabilizer of FIG. 1*c* illustrating a stabilizer having a rear support portion extending upward therefrom.

This patent application claims priority from U.S. Provisional Patent Application No. 62/754,900, filed Nov. 2, 2018, the disclosure of which is incorporated by reference herein in its entirety.

In the following description, numerous specific details are set forth in order to provide a thorough understanding of the various embodiments. It will be understood by those of ordinary skill in the art that these embodiments may be practiced without some of these specific details. In other instances, well-known methods, procedures, components and structures may not have been described in detail so as not to obscure the disclosed invention.

It is to be understood that the embodiments are not limited in their application to the details of construction and the arrangement of the components set forth in the following description or illustrated in the drawings. The embodiments may be practiced or carried out in various ways. Also, it is to be understood that the phraseology and terminology employed herein are for the purpose of description and should not be regarded as limiting.

It should also be appreciated that certain features, which are, for clarity, described in the context of separate embodiments, may also be provided in combination in a single embodiment. Additionally, specific features and structures described in conjunction with one embodiment and providing a specific function may be employed in other embodiments provided such a configuration is consistent with the provision of the specific function in the other embodiments. Conversely, various features, which are, for brevity, described in the context of a single embodiment, may also be provided separately or in any suitable sub-combination.

In various embodiments, the deck interlock apparatus inhibits relative vertical movement between adjacent tiers of bleacher decking of a retractable bleacher. The deck interlock apparatus includes a first engagement member secured to a first decking tier and a second engagement member secured to a second adjacent decking tier. The first engagement member and the second engagement member are configured, arranged and cooperative to prevent vertical movement of the second decking tier with respect to the first decking tier when the retractable bleacher is fully extended to provide a rigid connection or interlock between adjacent tiers. In this manner, deck slap is avoided and a firm walking surface is provided for users of the bleacher. Further, a consistent rise from tier to tier is assured. The first and second engagement members may be mounted to stabilizers, frame members or the like, as described in greater detail below.

Referring to FIG. 2*a*-7*b*, the retractable bleacher includes decking 200 and a riser 202 extending upward from the rearward end of the decking 200. The decking 200 and associated risers 202 provide decking tiers that may be fully retracted or fully extended between closed and open configurations respectively. In the closed configuration, the bleacher tiers are stacked vertically, one over the other, to occupy less floor space.

Figure 2A:
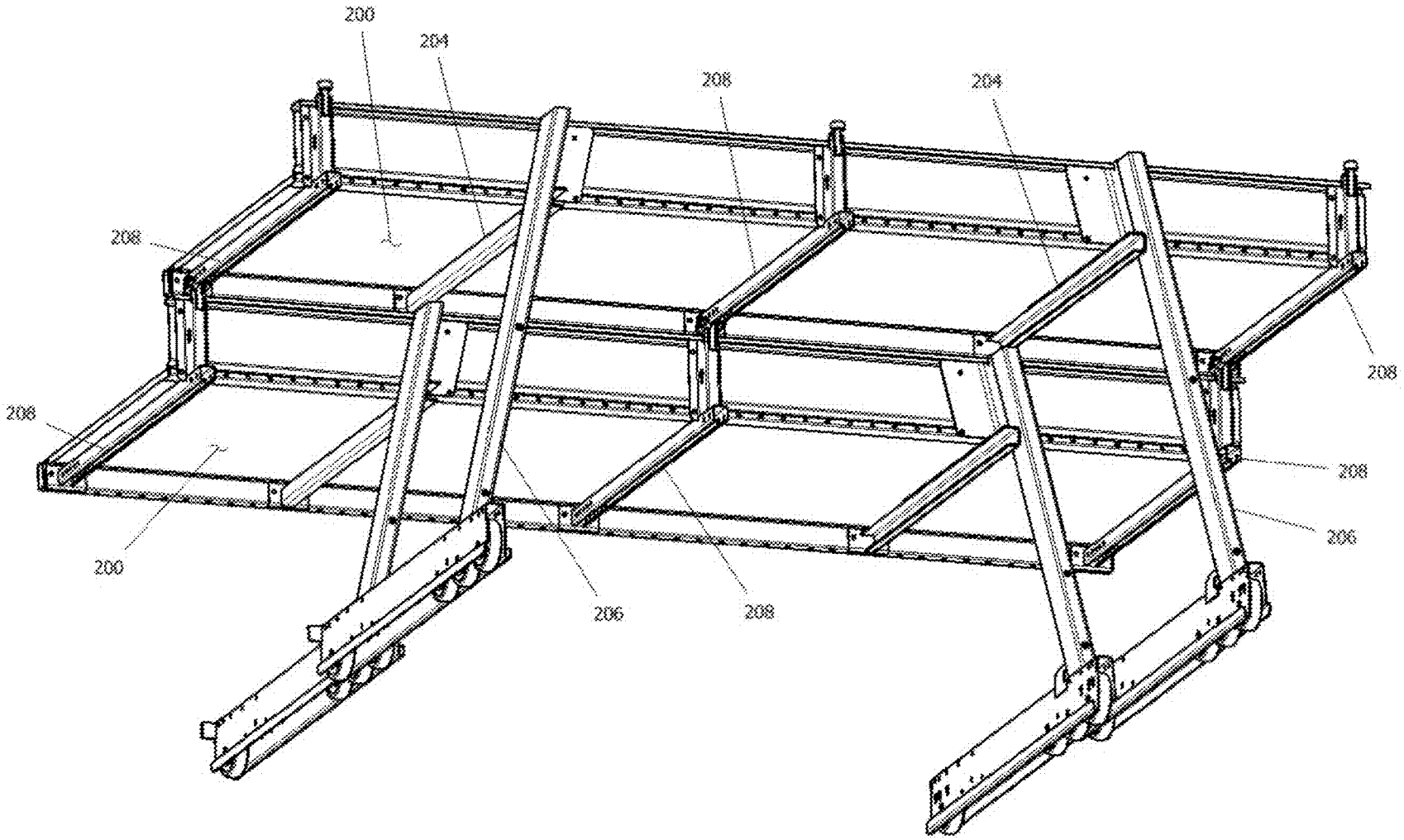
FIG. 2*a* is a perspective view of a portion of a bleacher frame understructure.
Figure 2B:
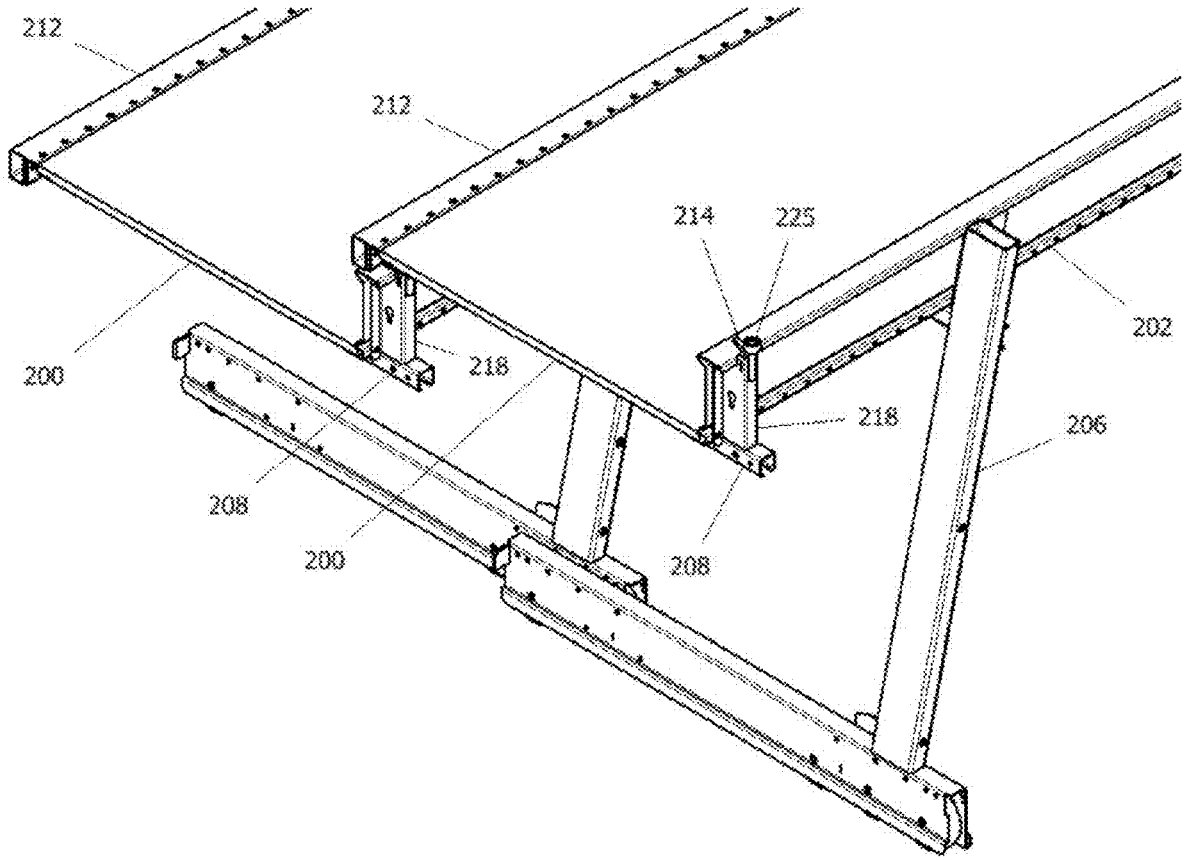
FIG. 2*b* is an enlarged perspective view of a portion of the retractable bleacher of FIG. 2*a* illustrating a first stabilizer associated with a first lower tier of the bleacher, and a second stabilizer associated with a second upper tier of the bleacher.

Seating is typically disposed on the decking 200 of the bleacher tiers. The individual tiers comprise deck assemblies supported by cantilevers 204 that include supporting columns 206 as illustrated in FIG. 2*a*. Each tier also typically includes "deck supports" or "deck stabilizers" (henceforth to be referred to as "deck stabilizers" or "stabilizers") 208. The deck stabilizers 208 provide a supporting structure for the decking 200, and tie the rear beam or rear riser 202 to the front beam or nose 212. The number of deck stabilizers 208 typically vary from 3 per tier to up to 5 per tier, depending upon the details of the design although any suitable number of deck stabilizers 208 may be employed. The present deck interlock apparatus further includes a pawl 214 and a capture bracket 216 as described in greater detail below. The pawl 214 and the capture bracket 216 are cooperative to securely provide a designed vertical operational clearance between adjacent tiers when the retractable bleacher is fully extended and avoid deck slap while users are traversing the bleacher when it is fully extended.

When a retractable bleacher is being extended from the closed configuration in which the decking tiers are vertically stacked one over the other to the open configuration in which the retractable bleacher is fully extended for use, the lower decking tier including the decking stabilizers 208 associated with the lower decking tier move longitudinally with respect to the decking stabilizers 208 of the upper tier including the decking stabilizers associated with the upper tier. The decking stabilizers move longitudinally in a direction generally perpendicular to the nose 212 of the retractable bleacher. By way of example, consider a retractable bleacher with four (4) decking tiers identified as tiers 1 to 4, where tier 1 is the lowest tier and tier 4 is the highest tier. As the bleacher opens from a closed vertical stack, tier 1 extends with respect to tiers 2-4 (which remain vertically stacked), tiers 1 and 2 extend with respect to tiers 3-4 (which remain vertically stacked), and finally tiers 1-3 extend with respect to tier 4. The bleacher is now fully open. Similarly, with closing: tier 1 closes under tier 2, tiers 1-2 (now vertically stacked) close under tier 3, and finally tiers 1-3 (vertically stacked) close under tier 4. The bleacher is now closed. Thus, during opening, the pawl typically approaches the capture bracket.

It should be noted that the above description describes a typical "forward-fold" operation in which the top tier is fixed and the frames roll forward for opening, starting with the first tier. There is an alternate operation known as "reverse-fold" in which the first tier, not the top tier, is fixed and the frames roll backward for opening, starting with the top tier. Using the same 4 tier example, as the bleacher opens from a closed stack, tier 4 extends back away from tiers 1-3 which remain stacked, tiers 3-4 extend back away from tiers 1-2 which remain stacked, and finally tiers 2-4 extend back away from tier 1. The bleacher is now fully open. Similarly, with closing: tiers 2-4 close over tier 1 (causing tier 1-2 to be stacked), tiers 3-4 close over the stacked tiers 1-2 (causing tier 1-3 to be stacked), and finally tier 4 closes over the stacked tiers 1-3 to make a vertical stack. The bleacher is now closed. Operationally, the pawl to capture bracket relation functions analogously—rather than the pawl approaching the capture bracket, the capture bracket approaches the pawl.

The pawl 214, in one embodiment, is a cast steel part although it may be manufactured from any suitable material such as a hard and durable plastic. Each stabilizer 208 includes a generally vertically extending rear support portion 218. A pawl 214 having a pawl finger 214*a* is affixed to an upper extent of the rear support portion 218 of each deck stabilizer 208.

Figure 2C:
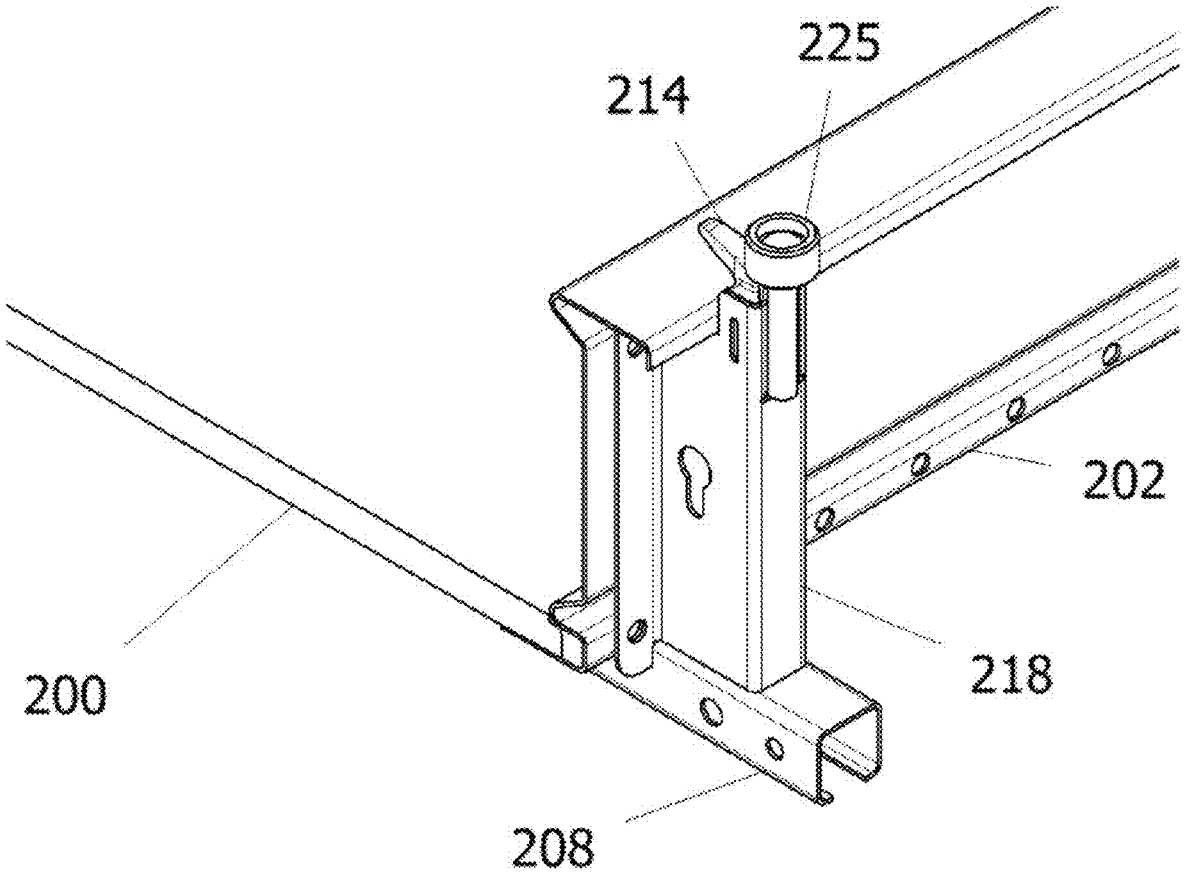
FIG. 2*c* is an enlarged perspective view of a portion of the retractable bleacher of FIG. 2*b* illustrating a pawl mounted to a rear support portion extending upward from a stabilizer.
Figure 2D:
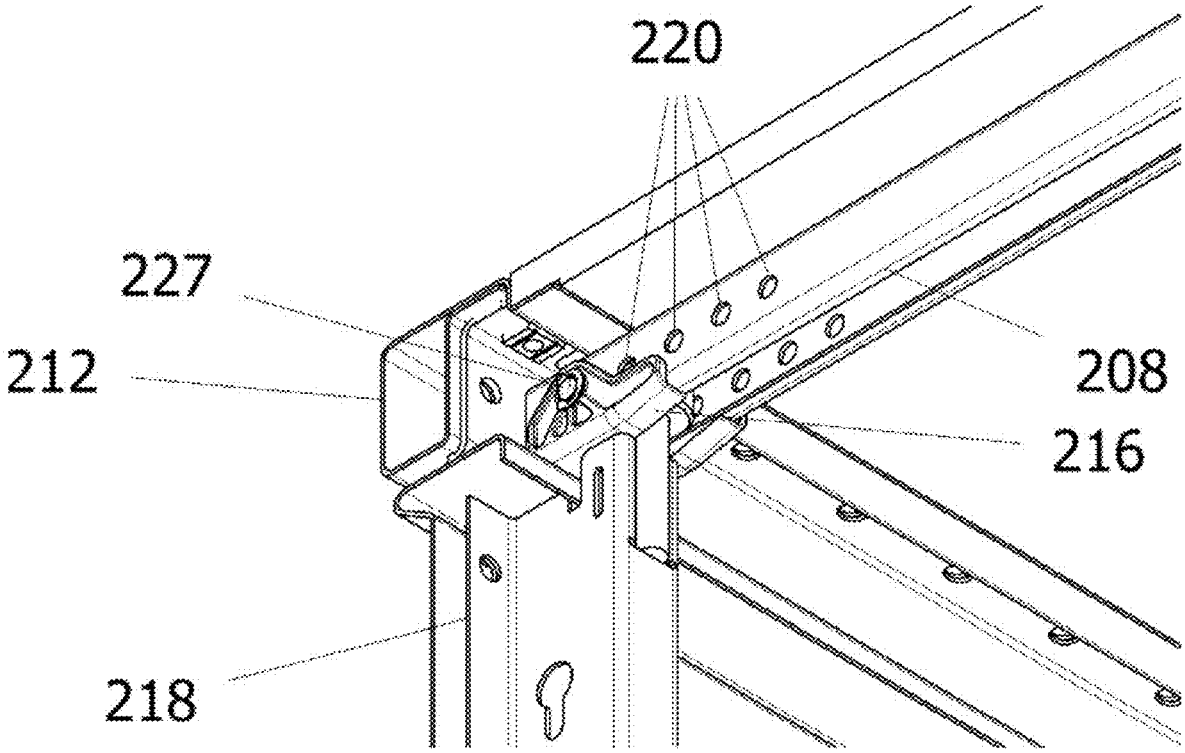
FIG. 2*d* is an alternative perspective view of a portion of the retractable bleacher of FIG. 2*b* illustrating a capture bracket mounted to the forward end of a stabilizer with the retractable bleacher fully extended.
Figure 3A:
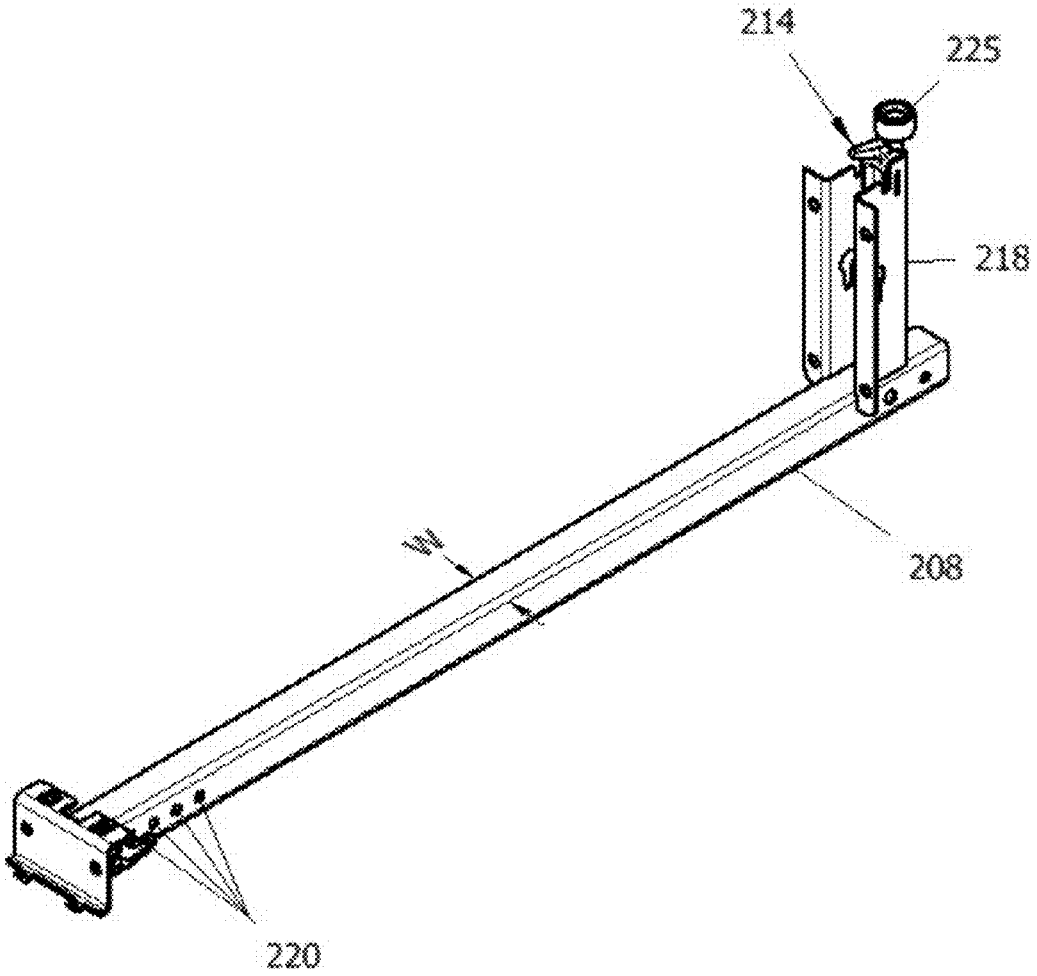
FIGS. 3*a*, 3*b* and 3*c* are different views of a deck stabilizer in accordance with an embodiment including a pawl mounted to a rear support portion and a capture bracket mounted to the forward end.
Figure 3B:
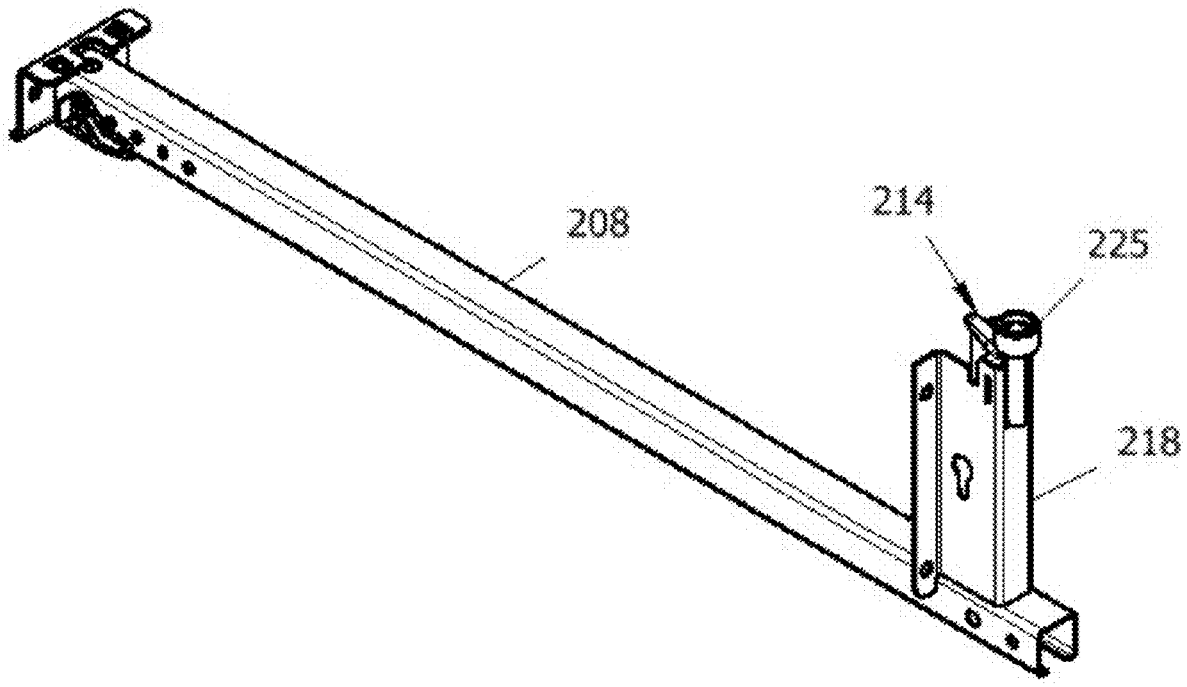
Figure 3C:
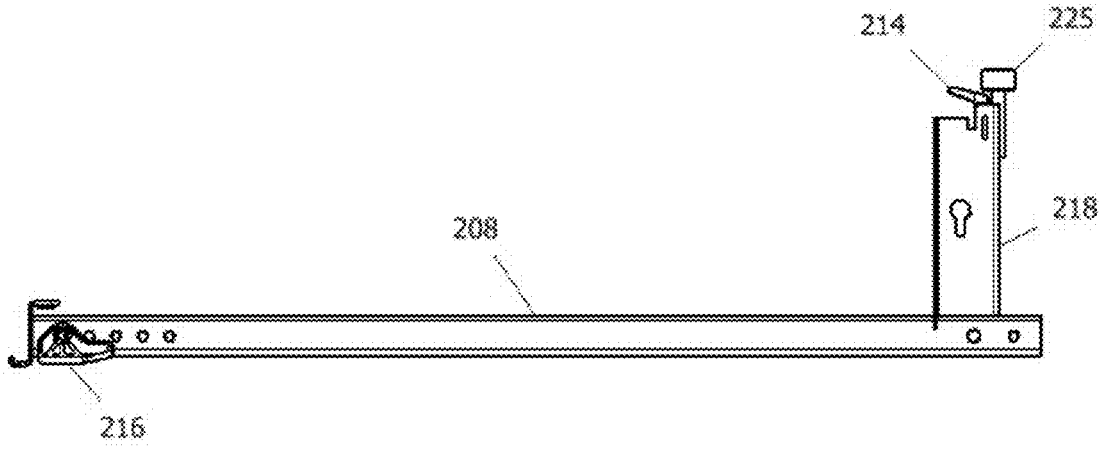
Figure 4:
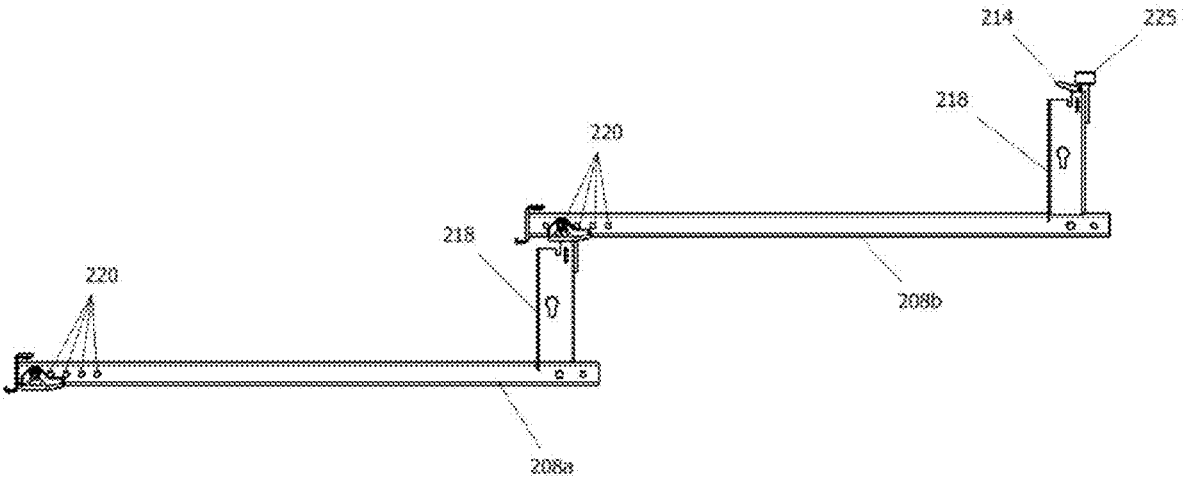
FIG. 4 is a side elevation view of first and second stabilizers as configured when the retractable bleacher is fully extended and illustrating the engagement of a pawl on the lower tier stabilizer by a capture bracket on the upper tier upper tier stabilizer.
Figure 6:
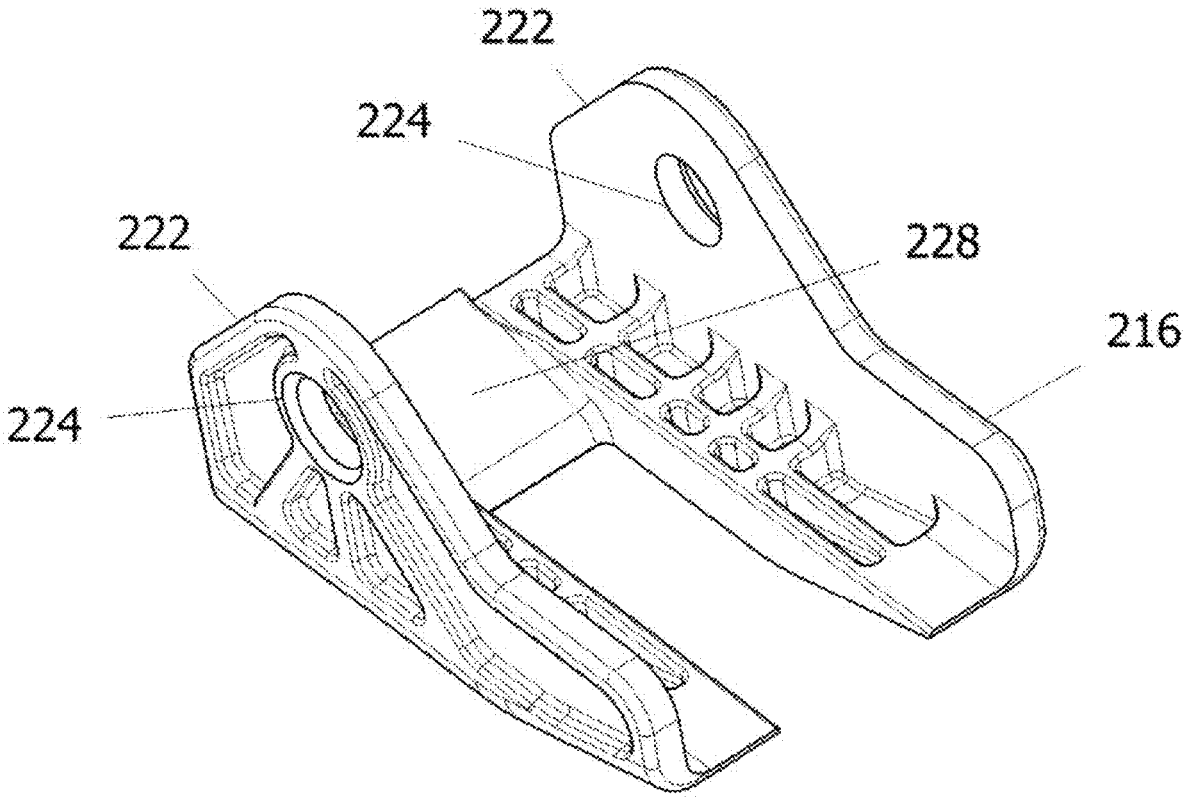
FIG. 6 is a perspective view of a capture bracket.
Figure 7A:
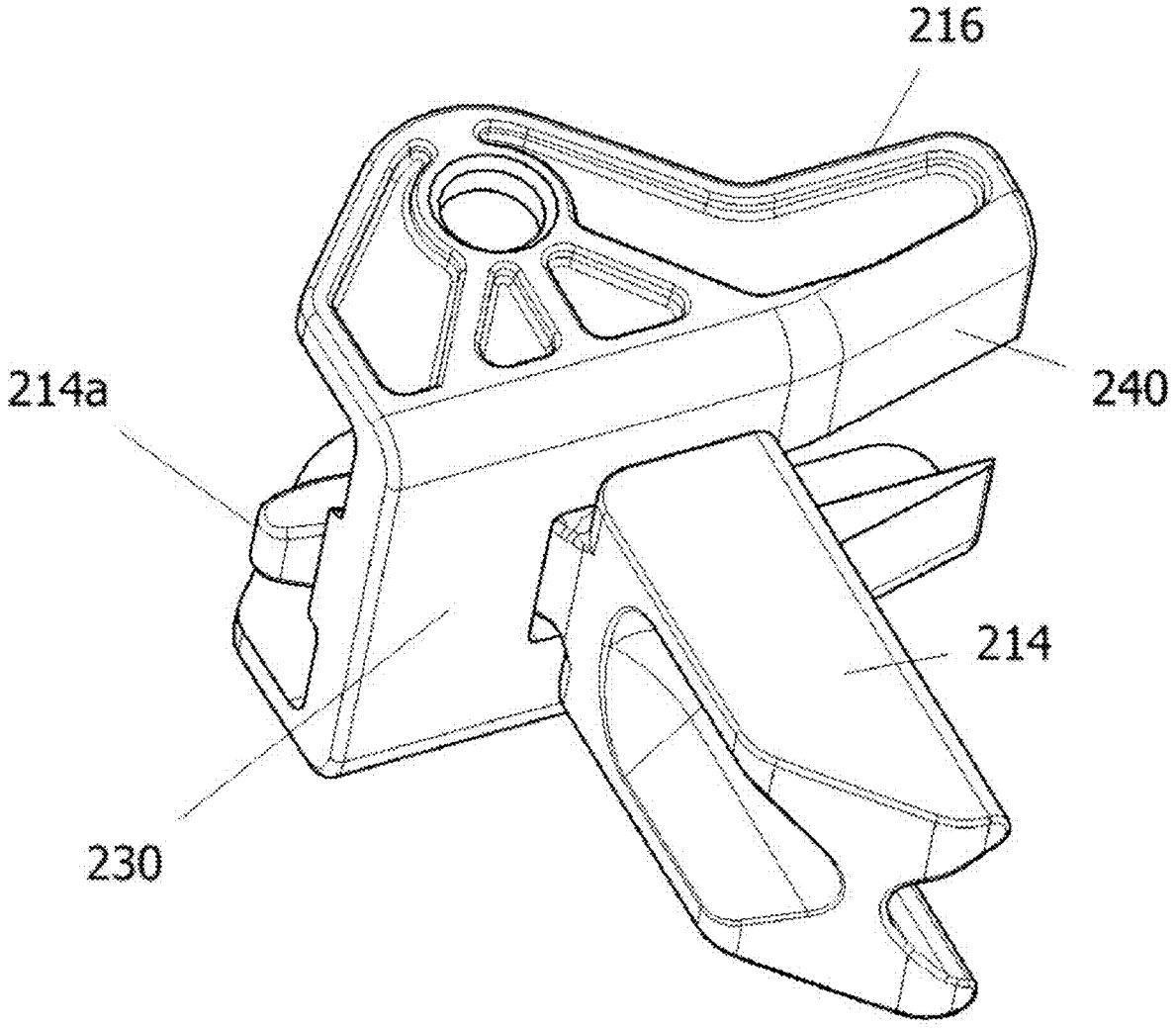
FIGS. 7*a* and 7*b* depict different perspective views of the pawl mated to the capture bracket in abutting engagement as it would be with the retractable bleacher fully extended with the bottom of the capture bracket resting on shoulders of the pawl with an inclined downward facing surface of the pawl finger in abutting engagement with an upward facing inclined surface of the capture bracket.
Figure 7B:
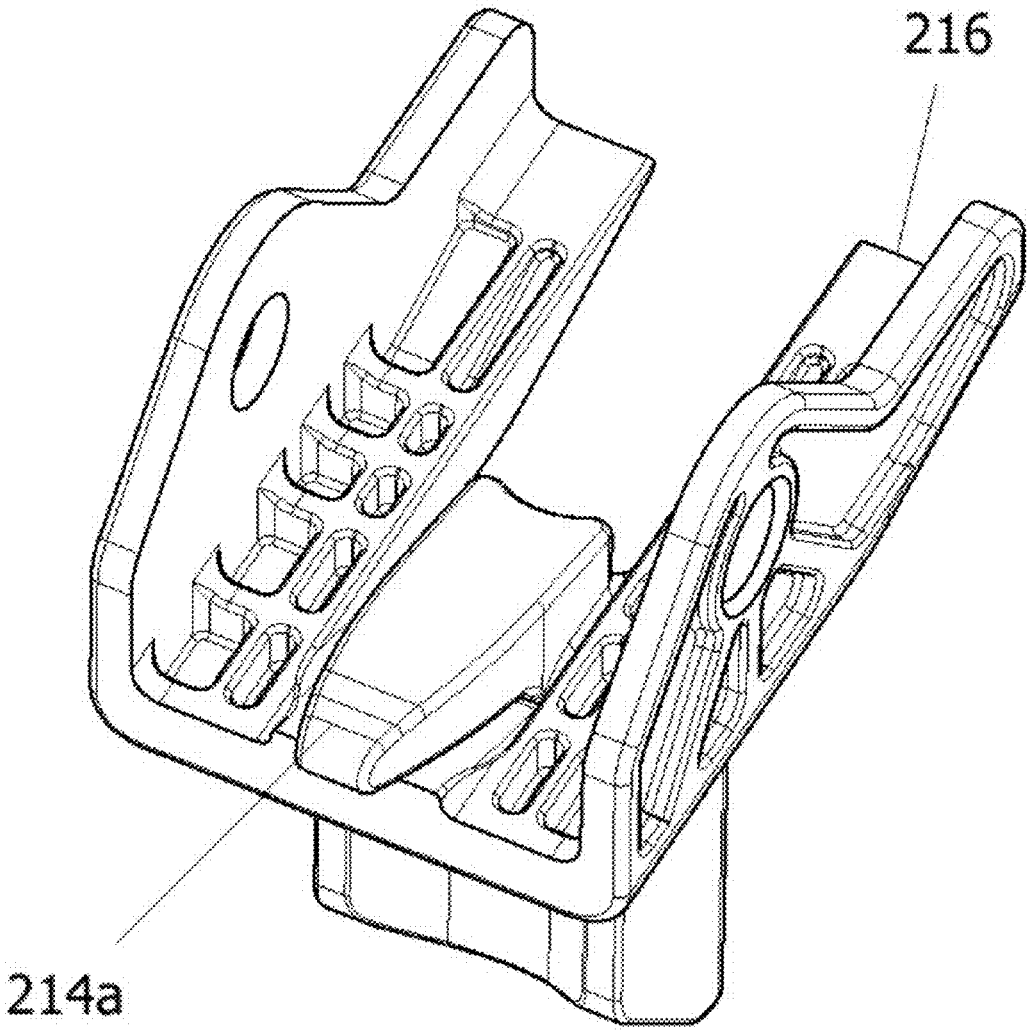

The capture bracket 216 in one embodiment is a plastic part although it may be fabricated of any other suitable material. The capture bracket 216 is secured to the forward end of each deck stabilizer 208. In one embodiment a series of opposed pairs of holes 220 are provided near the forward of each stabilizer 208 corresponding to the designed bleacher row spacing. As illustrated in FIG. 6, the capture bracket 216 includes opposed spaced upstanding flanges 222 that extend from the capture bracket 216 base. The flanges 222 include a pair of opposed spaced holes 224. The spacing between the flanges 222 is slightly greater than the width "w" of the stabilizer 208. (See FIG. 3*a*). In one embodiment, the capture bracket 216 is mounted to the stabilizer 208 with the inner sides of the flanges 222 adjacent opposing sides of the stabilizer 208 with the holes 224 through the flanges 222 aligned with a pair of holes 220 through the stabilizer 208. A pin 227 is disposed through the holes 224 of the flanges 222 and a pair of the holes 220 through the stabilizer 208 to secure the capture bracket 216 to the forward end of the stabilizer 208. The holes of the stabilizer 208 at which the capture bracket 216 is secured to the stabilizer 208 is dictated by the designed row spacing or depth of the bleacher decking. The stabilizer 208 is a generally rectangular U-shaped channel having an open lower surface as illustrated in FIG. 2*c*. In other non-limiting embodiments, a stabilizer may take an alternative shape.

A pawl 214 is mounted at or near the upper extent of the rear support portion 218 of each stabilizer 208 and is aligned so that a pawl finger 214*a* of the pawl 214 extends through the opening in the lower surface of the U-shaped channel of the stabilizer 208. The pawl finger 214*a* traverses the interior of the U-shaped channel of the stabilizer 208 as the retractable bleacher is opened or closed. Rollers or disks 225 having a generally vertical axis are mounted in the upper portion of the rear support portions 218 and are movable within the U-shaped channel of the stabilizers 208 as the retractable bleacher is opened or closed to provide lateral stability of adjacent bleacher tiers.

When the bleacher is fully extended, downward facing inclined surfaces 226 of pawl fingers 214*a* of pawls 214 mounted to the rear support portions 218 of stabilizers 208*a* of a first tier engage in abutting relation upward facing inclined surfaces 228 of capture brackets 216 mounted to the forward end of the stabilizers 208*b* and securely fix the respective tiers vertically with respect to one another so as to prevent vertical movement therebetween while maintaining designed vertical operational clearance.

Figure 5A:
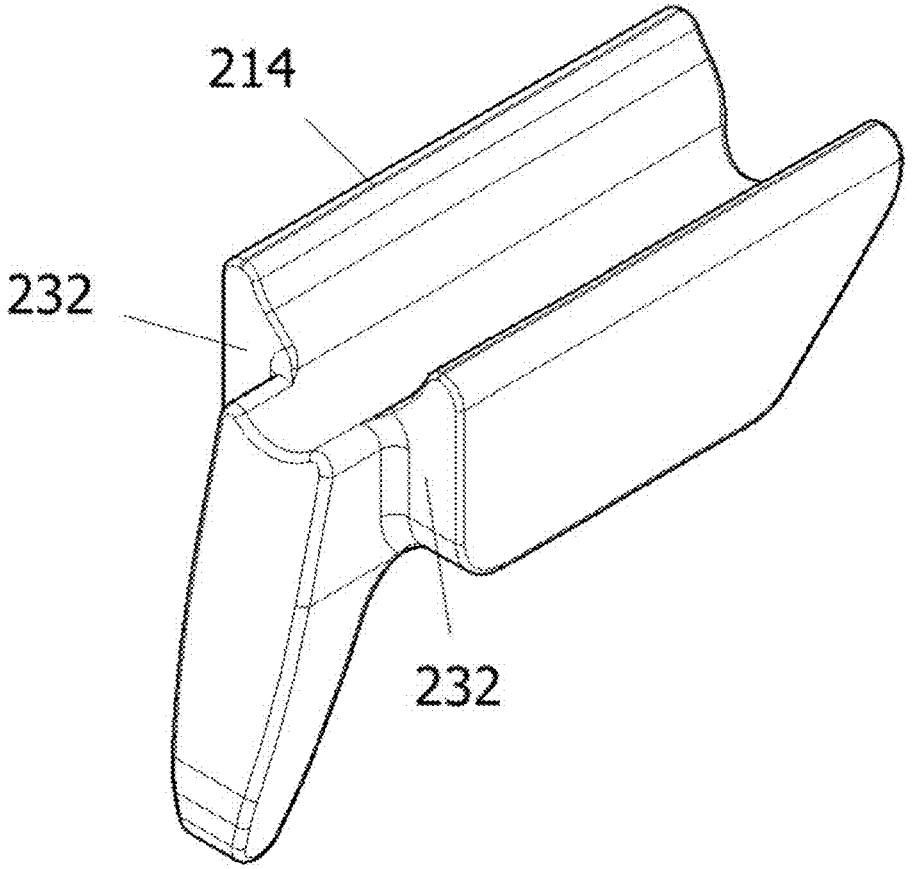
FIGS. 5*a* and 5*b* illustrate first and second views of a pawl and pawl finger.
Figure 5B:
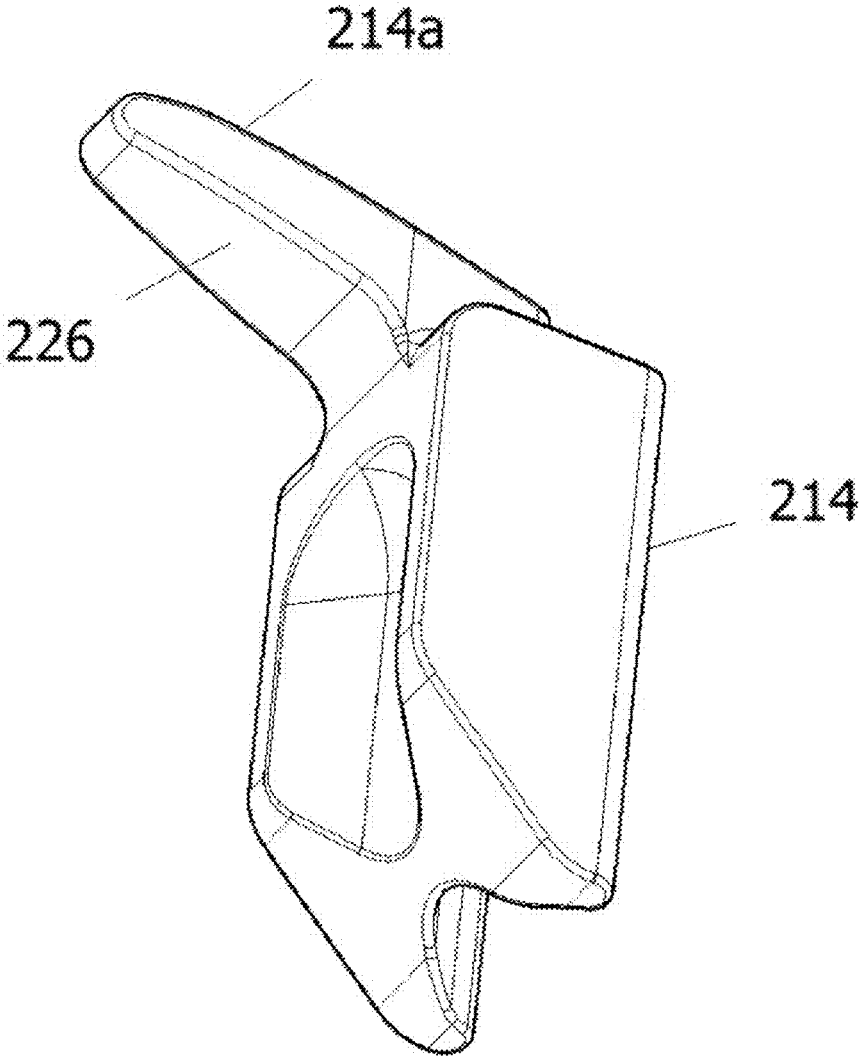

FIGS. 5*a* and 5*b* provide further detail of the pawl 214 and FIG. 6 provides further detail of the capture bracket 216. The pawl finger 214*a* having a downward facing inclined surface 226. The capture bracket 216 includes a cooperative upward facing inclined surface 228. The two surfaces of these parts mate in abutting relation when the retractable bleacher is fully extended. When the retractable bleacher is fully extended, the bottom surface 230 of the capture bracket 216 rests on the shoulders 232 of the pawl 214. The two parts cannot move vertically with respect to one another with this geometry. While the present embodiment employs a pair of shoulders on the pawl 214, a single shoulder or a single surface may be provided that is cooperative with an abutting bottom of the capture bracket 216.

The design of the pawl 214 and capture bracket 216 are such that as the pawl finger 214*a* approaches the capture bracket 216 as the retractable bleacher is extended, if the capture bracket 216 is too high, the pawl 214 will force the capture bracket 216 downward and will also pull the deck of the associated tier downward with it to properly secure the two tiers in the designed vertical orientation with respect to one another. Additionally, as the pawl finger 214*a* approaches the capture bracket 216 as the retractable bleacher is extended, if the capture bracket 216 is too low, inclined bottom surfaces 240 of the capture bracket 216 engage the shoulders 232 of the pawl 214 to force the capture bracket 216 upward to drive the deck of the associated upper tier upward until a generally flat portion 230 of the bottom surface of the capture bracket 216 rests on the pawl shoulders 232 so as to achieve the proper vertical orientation of the tiers with respect to one another. Either way, with inclined surface 226 of the pawl 214 in abutting engagement with the inclined surface 228 of the capture bracket 216, and the bottom surface 230 of the capture bracket 216 resting on the shoulders 232 of the pawl 214, adjacent decking tiers are mechanically secured against vertical movement with respect to each other, e.g., no relative movement either up or down can occur. Anyone standing on such a deck will feel no motion of the deck and "deck slap" is avoided. The deck will have a very solid feel, as though it were a fixed, non-telescopic structure.

Figure 8:
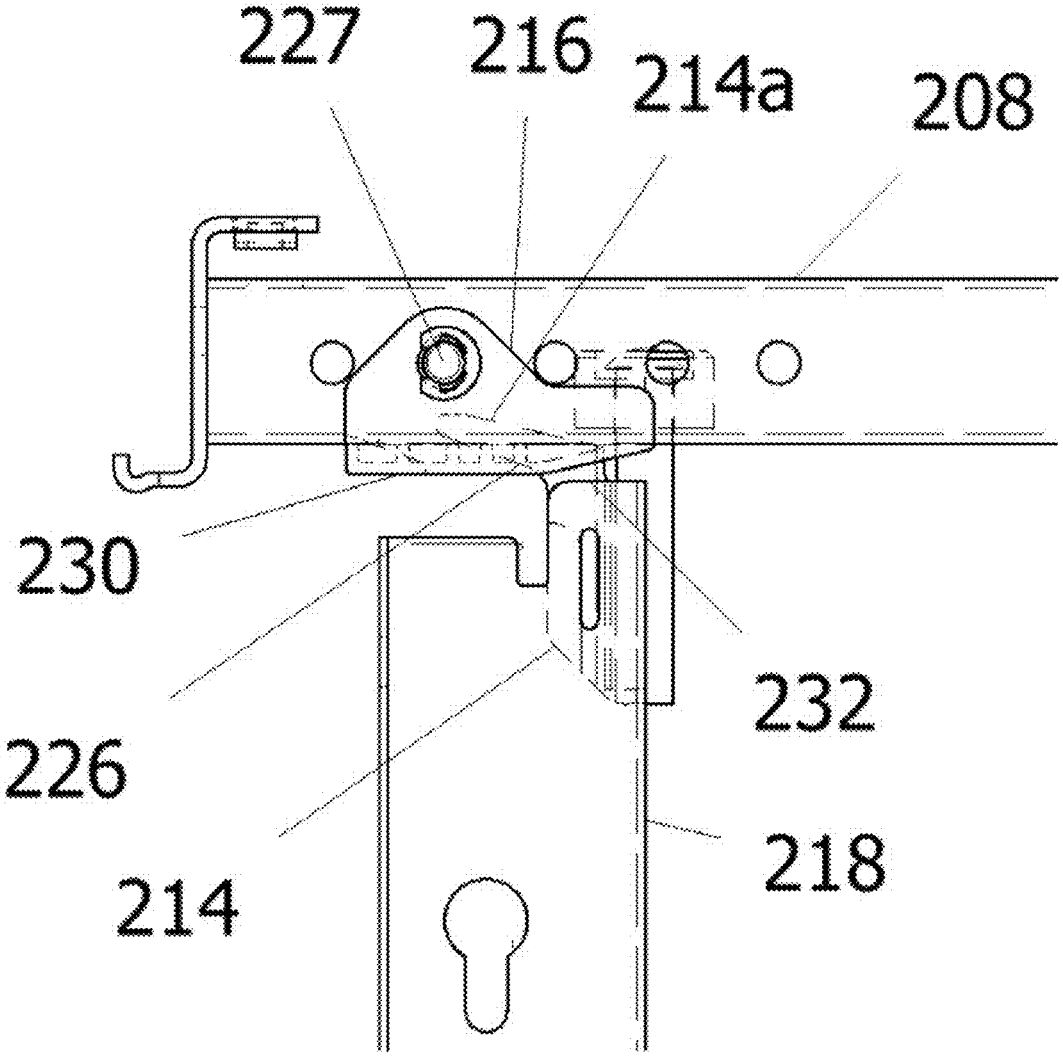
FIG. 8 is a side view illustrating a nominal operating clearance approach of the pawl with respect to the capture bracket just prior to full extension of the retractable bleacher.

FIGS. 8-11 illustrate the cooperative engagement of the capture bracket 216 with the pawl 214 as the capture bracket 216 engages the pawl 214 with nominal, high and low approaches. As illustrated in FIG. 8, with a nominal approach, the bottom surface of the capture bracket 216 is disposed generally at the level of the shoulders 232 of the pawl 214. When the pawl 214 approaches the capture bracket 216 as the retractable bleacher extends, the capture bracket 216 and the pawl 214 assume the position illustrated in FIG. 11 in which the bottom surface 230 of the capture bracket 216 is disposed in abutting relation on the shoulders 232 of the pawl 214. The pin 227 that secures the capture bracket 216 to the stabilizer 208 also serves as a stop pin that limits the travel of the capture bracket 216 with respect to the pawl 214 and defines the final seated position of the capture bracket 216 with respect to the pawl 214. In the illustrated embodiment, the travel of a stabilizer 208 of a first decking tier with respect to a stabilizer 208 of an adjacent second decking tier that is above the first decking tier is limited when the disk or roller 225 abuts the pin 227 upon full extension of the retractable bleacher or when the pawl is fully seated on the capture bracket. Any other suitable mechanism for limiting the travel of cooperative decking stabilizers 208 may be employed.

Figure 9:
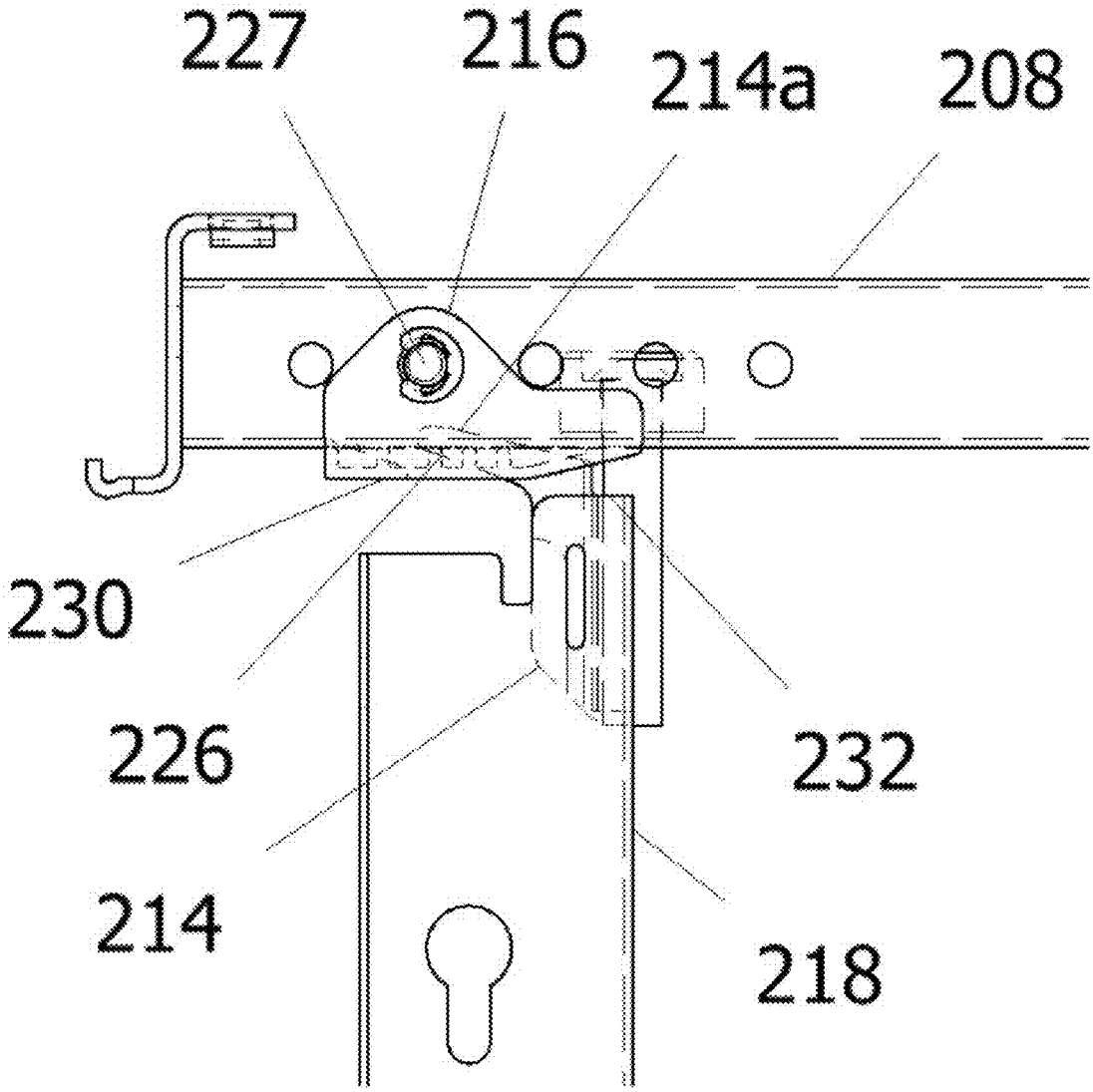
FIG. 9 is a side view illustrating a high operating clearance approach of the pawl to the capture bracket just prior to full extension of the retractable bleacher.

FIG. 9 illustrates a high approach of the capture bracket with respect to the pawl 214. With a high approach, the bottom surface 230 of the capture bracket 216 is disposed generally at the level above the shoulders 232 of the pawl 214 during the approach. The bottom surface 226 of the pawl finger 214*a* is configured as an inclined ramp which is cooperative with an upward facing surface 228 of the capture bracket 216 (See FIG. 6) which is also formed as an inclined ramp. When the pawl 214 approaches the capture bracket 216 as the retractable bleacher extends, the cooperative engagement of the respective ramps forces the capture bracket 216 and the pawl 214 to assume the position illustrated in FIG. 11 in which the bottom surface 230 of the capture bracket 216 is disposed in abutting relation on the shoulders 232 of the pawl 214. The relative movement of pawl 214 with respect to the capture bracket 216 forces the upper decking tier downward toward the lower adjacent decking tier until the upper decking tier is precisely vertically located with respect to the lower adjacent decking tier. Travel of a lower stabilizer 208 with respect to an upper stabilizer is limited when the disk or roller 225 that is associated with the lower decking tier and disposed within the generally U-shaped channel of a stabilizer 208 of an adjacent upper decking tier abuts the pin 227 upon full extension of the retractable bleacher or when the pawl 214 finally seats on the capture bracket 216 as described above.

Figure 10:
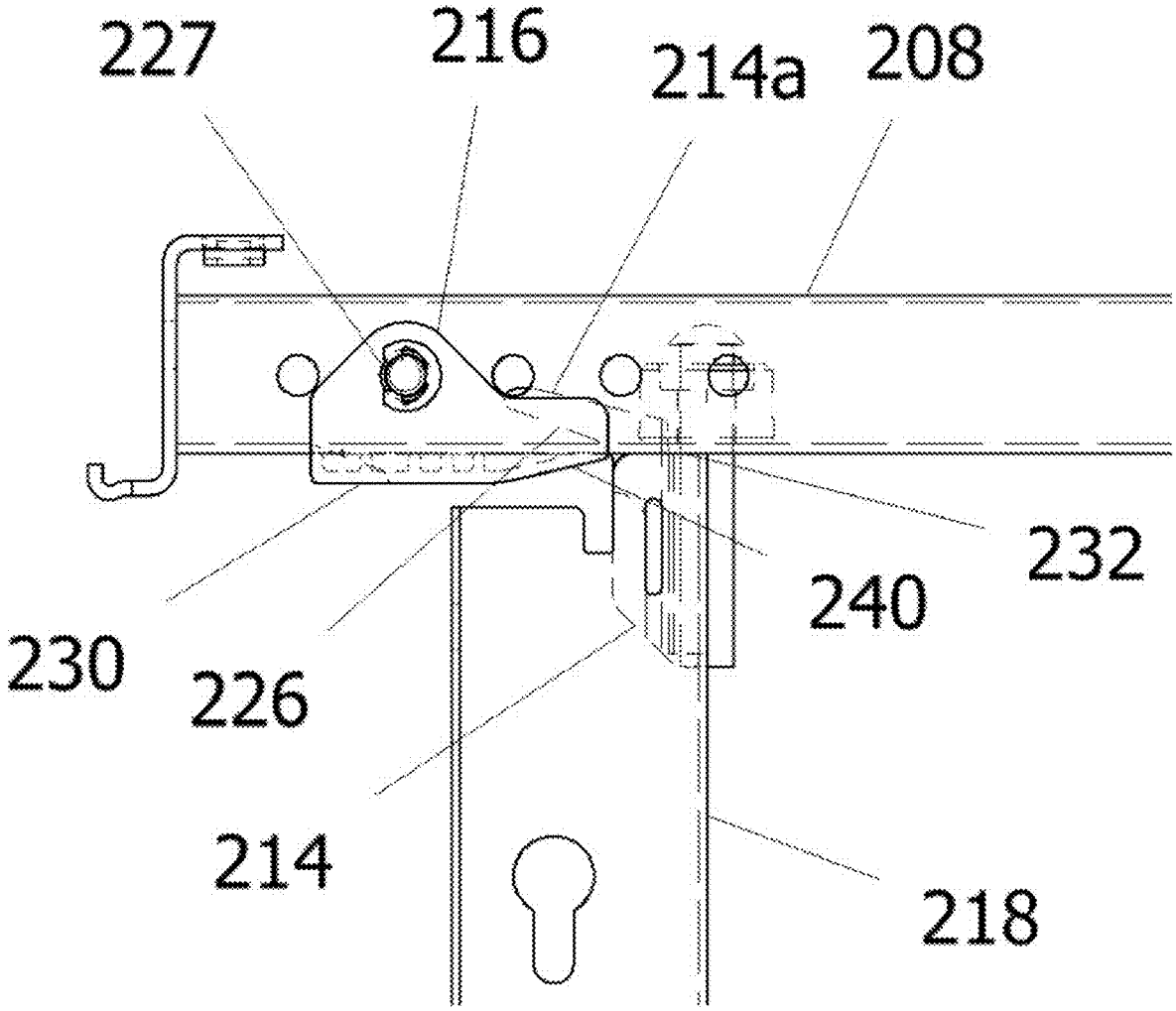
FIG. 10 is a side view illustrating a low operating clearance approach of the pawl to the capture bracket as the pawl approaches the inclined ramp on the bottom of the capture bracket just prior to full extension of the retractable bleacher.

FIG. 10 illustrates a low approach of the capture bracket with respect to the pawl 214. With a low approach, the bottom surface 230 of the capture bracket 216 is disposed generally at the level below the shoulders 232 of the pawl 214 during the approach. The capture bracket 216 includes a bottom surface portion 240 configured as an inclined ramp (See FIG. 7*a*) that is cooperative with an edge of the pawl shoulders 232 to force the capture bracket 216 and the associated stabilizer to which it is affixed upward until the capture bracket 216 assumes the final seated position illustrated in FIG. 11 with the bottom surface 230 of the capture bracket 216 disposed in abutting relation on the shoulders 232 of the pawl 214. The relative movement of the pawl 214 with respect to the capture bracket 216 forces the stabilizer 208 of the upper decking tier upward away from the stabilizer 208 of the lower adjacent decking tier until the upper decking tier is precisely vertically located with respect to the lower adjacent decking tier. Travel of a lower stabilizer 208 with respect to an upper stabilizer is limited when the disk or roller 225 that is associated with the lower decking tier and disposed within the generally U-shaped channel of a stabilizer 208 of an adjacent upper decking tier abuts the pin 227 or when the pawl 214 finally seats on the capture bracket 216 as described above.

Figure 11:
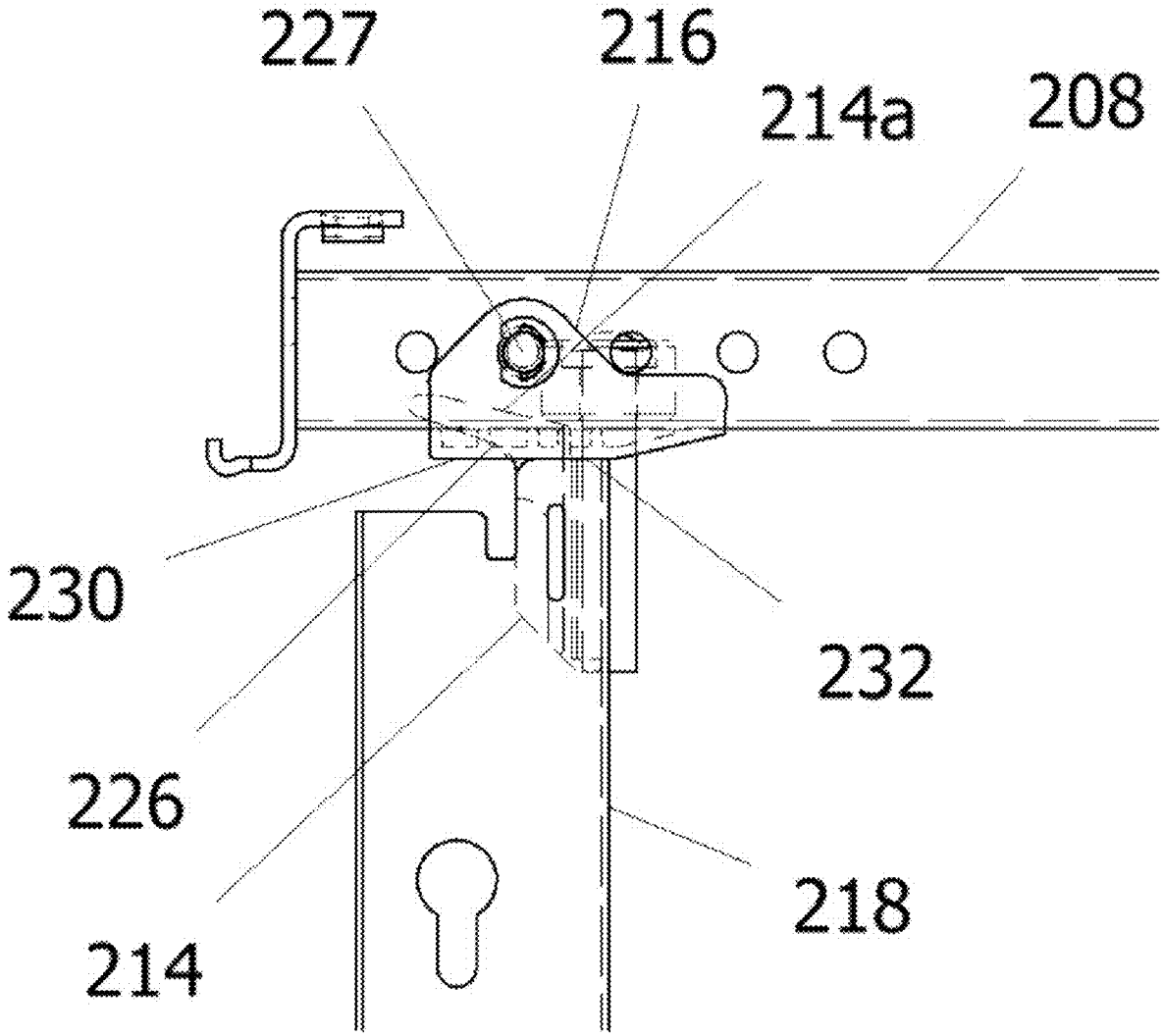
FIG. 11 is a side view illustrating the positioning of the capture bracket with respect to the pawl upon full extension of the retractable bleacher irrespective of the approach of the capture bracket with respect to the pawl.

FIG. 11 is a side view illustrating the final seated position of the capture bracket 216 with respect to the pawl 214. This position is obtained irrespective of whether the approach of the capture bracket 216 with respect to the pawl 214 is a nominal, high or low approach.

The above-described deck interlock apparatus offers significant improvements when incorporated into existing retractable deck structures as noted below.

The interlock apparatus is self-adjusting—no installer adjustments are necessary.

The interlock apparatus can be located at deck stabilizer locations (typically between 3 and 5 per tier or more). Adjustable cantilever designs occur only at 2 per tier.

The decking interlock apparatus may also be implemented at frame locations.

With the folding and telescopic seating fully extended and the deck interlock mechanism engaged, there can be no vertical movement between adjacent tiers—the decks are locked together. The result is a more quiet, safer design.

The deck interlock mechanism ensures adjacent decks are vertically located at their exact rise. For example, if the design rise is 10", the locked rise will be exactly 10". Without the presently disclosed deck interlocks, for example, it would not be unusual to measure tiers at 10.25" rise, due to varying camber of the decks (for designs that utilize camber or adjustable cantilevers). Deck interlocks ensure the design rise is consistently met tier by tier. This is important in achieving a consistent, non-varying rise in the aisles.

Engagement of the interlock members occurs only at the last fractional inch of opening travel—and is disengaged at the initial moment of closing—thereby adding no detrimental operating friction to the system.

The deck interlock mechanism adds another level of telescopic seating safety by providing an engagement, or interlock, between adjacent tiers. It also adds safety by eliminating any deck movement, particularly on lightly loaded telescopic platforms, and by ensuring a consistent, non-varying rise.

The deck interlock mechanism is very easy to install, adding little or no installation time.

In one embodiment, the first and second engagement members have been illustrated in the form of a pawl and a capture bracket. It should be appreciated by those of ordinary skill, that other configurations of the first and second engagement members may be employed without departing from the concepts herein described. By way of example and not limitation, any first and second engagement members that include cooperative ramps, wedges, ramps and pins, or other structures that correct for vertical misalignment of the adjacent decking tiers in response to full extension of the retractable bleacher are contemplated as being within the scope of the present disclosure.

As described above, the interlock mechanism includes first and second engagement members in the form of a pawl and a capture bracket that are mounted to first and second stabilizers of the retractable bleacher. It should be appreciated that the presently disclosed interlock mechanism may be employed at the retractable bleacher frame members rather than at the stabilizers as described above. Typically, in retractable bleacher systems, the top of the lower tier frame column tracks into the cantilever of the upper tier frame as the bleacher opens and closes. Accordingly, a first engagement member, such as a pawl, may be disposed on the top of the column, and a second engagement member, such as the disclosed capture bracket may be disposed on the front of the cantilever. In fact, the interlock mechanism can be stand-alone designed to be independently mounted anywhere along the riser/nose line.

For clarity of description and illustration, an interlock mechanism has been described herein that provides for a rigid interlock of first and second tiers of a retractable bleacher when the bleacher is fully extended. However, retractable bleachers may employ any number of decking tiers and the presently disclosed interlock system employing first and second cooperative engagement members may be employed to rigidly maintain the vertical orientation of some or all of the adjacent decking tiers. By way of example and not limitation, it is not uncommon for retractable bleacher systems to include up to 5, 10, 20 or 30 decking tiers and the presently disclosed interlock mechanism may be employed to vertically secure each of the decking tiers with respect to their adjacent decking tiers.

It should be recognized by those of ordinary skill in the art that modifications to and variations of the above-described apparatus and method for fabricating and using a retractable bleacher having a bleacher interlock mechanism to rigidly secure adjacent bleacher tiers in a designed vertical orientation to avoid deck slap may be made without departing from the concepts disclosed herein. Accordingly, the invention is not to be viewed as limited except by the scope and content of the appended claims.

What is claimed is:

1. An apparatus to prevent relative vertical movement of adjacent decking tiers of a retractable bleacher that includes at least a first decking tier and a second decking tier, wherein the retractable bleacher is reconfigurable between an open configuration in which the retractable bleacher is fully extended and a closed configuration in which the first decking tier and the second decking tier are stacked vertically, the apparatus comprising:

a first engagement member secured to the first decking tier;

a second engagement member secured to the second adjacent decking tier;

wherein the first engagement member and the second engagement member are configured and cooperative to provide a rigid connection between the first tier and the second tier which prevents relative vertical movement of the second decking tier with respect to the first decking tier when the retractable bleacher is fully extended in the open configuration, wherein the rigid connection mechanically secures the first tier against both upward and downward vertical movement relative to the second tier.

2. The apparatus of claim 1, wherein the first decking tier includes a first decking stabilizer secured to the first decking tier, the first decking stabilizer having a forward end and a rearward end and a rear support portion extending to a distal end from the rearward end of the first decking stabilizer, the first engagement member comprising a pawl secured to the distal end of the rear support portion; and the second decking tier including a second decking stabilizer secured to the second decking tier, the second decking stabilizer disposed at a height above the first decking stabilizer, the second decking stabilizer having a forward end and rearward end and moveable longitudinally in a direction parallel to the first decking stabilizer and at a height above the first decking stabilizer; wherein the second engagement member comprises a capture bracket secured to the forward end of the second decking stabilizer.

3. A deck interlock mechanism for a retractable bleacher having at least a first decking tier and a second decking tier, the retractable bleacher being reconfigurable between an open configuration in which the retractable bleacher is fully extended and a closed configuration in which the first decking tier and the second decking tiers are stacked vertically, the deck interlock mechanism comprising:

a first decking stabilizer associated with the first decking tier, the first decking stabilizer having a forward end and a rearward end, and a rear support portion extending vertically from the rearward end of the first decking stabilizer;

a pawl having a pawl finger, the pawl mounted to an upper end of the rear support portion wherein the pawl finger has a downward facing inclined surface and the pawl has at least one upward facing pawl shoulder;

a second decking stabilizer associated with the second decking tier disposed at a height above the first decking tier, the second decking stabilizer having a forward end and rearward end;

a capture bracket mounted to the forward end of the second decking stabilizer, the capture bracket having an upward facing inclined surface and a bottom surface, wherein the pawl and the capture bracket are configured such that when the retractable bleacher is fully extended, the downward facing inclined surface of the pawl finger is in abutting engagement with the upward facing inclined surface of the capture bracket and at least a portion of the bottom surface of the capture bracket is in abutting engagement with the at least one upward facing pawl shoulder to prevent vertical movement of the second decking tier with respect to the first decking tier.

4. An apparatus to prevent relative vertical movement of adjacent decking tiers of a retractable bleacher, wherein the adjacent decking tiers include at least a first decking tier and a second decking tier, wherein the retractable bleacher is reconfigurable between an open configuration in which the retractable bleacher is fully extended and a closed configuration in which decking tiers are stacked vertically, the apparatus comprising:

a first engagement member secured to the first decking tier;

a second engagement member secured to the second decking tier, wherein the second decking tier is adjacent to the first decking tier and vertically above the first decking tier;

wherein the first engagement member and the second engagement member are configured to provide an interlock between the first tier and the second tier which prevents relative vertical movement of the second decking tier with respect to the first decking tier when the retractable bleacher is fully extended in the open configuration.

5. The apparatus of claim 4, further comprising a rear support portion extending upward from a rearward end of the first decking tier, wherein the first engagement member comprises a pawl secured to a upper end of the rear support portion.

6. The apparatus of claim 5, further comprising a first decking stabilizer secured to the first decking tier, wherein the first decking stabilizer comprises the rear support portion.

7. The apparatus of claim 5, further comprising a first decking frame structure secured to the first decking tier, wherein the first decking frame structure comprises the rear support portion.

8. The apparatus of claim 5, wherein the first engagement member comprises a pawl finger and at least one shoulder surface.

9. The apparatus of claim 4, wherein the second engagement member comprises a capture bracket secured to a forward end of the second decking tier.

10. The apparatus of claim 9, wherein the capture bracket comprises at least one flange.

11. The apparatus of claim 4, wherein the second decking tier includes a second decking stabilizer secured to the second decking tier, the second stabilizer disposed at a height above the first decking tier, the second decking stabilizer having a forward end and a rearward end and moveable longitudinally in a direction generally parallel to the second decking stabilizer and at a height above the first decking tier.

12. The apparatus of claim 4, wherein the first engagement member comprises a first inclined surface and a downwardly facing surface, wherein the second engagement member comprises a second inclined surface and an upwardly facing surface, and wherein the first engagement member and the second engagement member are configured to cause the downwardly facing surface and the upwardly facing surface to mate in an abutting relation when the retractable bleacher is fully extended in the open configuration.

13. The apparatus of claim 12, wherein the first inclined surface is an upwardly facing sloped shoulder and the second inclined surface is a downwardly facing inclined surface of a flange.

14. The apparatus of claim 12, wherein the first inclined surface is a downwardly facing sloped surface of a pawl and the second inclined surface is an upwardly facing inclined surface of a capture bracket.

15. The apparatus of claim 4, wherein the interlock mechanically secures the first tier against both upward and downward vertical movement relative to the second tier and secures the second tier against both upward and downward vertical movement relative to the first tier.

* * * * *